US007937033B2

(12) United States Patent
Katabami et al.

(10) Patent No.: US 7,937,033 B2
(45) Date of Patent: May 3, 2011

(54) SEPARATING PLATE, FIXING DEVICE HAVING THE SEPARATING PLATE WITH AN EDGE PART THAT ABUTS WITH THE FIXING MEMBER, METHOD FOR PRODUCING THE SEPARATING PLATE AND IMAGE FORMING APPARATUS

(75) Inventors: Hiroshi Katabami, Chigasaki (JP); Hirokazu Kurihara, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 11/721,255

(22) PCT Filed: Dec. 16, 2005

(86) PCT No.: PCT/JP2005/023543

§ 371 (c)(1),
(2), (4) Date: Feb. 13, 2008

(87) PCT Pub. No.: WO2006/064969

PCT Pub. Date: Jun. 22, 2006

(65) Prior Publication Data

US 2009/0238615 A1 Sep. 24, 2009

(30) Foreign Application Priority Data

Dec. 17, 2004 (JP) ..... 2004-366252

(51) Int. Cl.
*G03G 15/20* (2006.01)

(52) U.S. Cl. ..... 399/323

(58) Field of Classification Search ..... 399/323, 399/328, 322

See application file for complete search history.

(56) References Cited

U.S. PATENT DOCUMENTS

| | | | | |
|---|---|---|---|---|
| 6,678,497 | B1 | 1/2004 | Murata | |
| 2002/0031648 | A1 | 3/2002 | Ohashi | |
| 2003/0081970 | A1 | 5/2003 | Yamamoto et al. | |
| 2008/0080909 | A1 * | 4/2008 | Yamada | 399/323 |

FOREIGN PATENT DOCUMENTS

| | | |
|---|---|---|
| JP | 02 216171 | 8/1990 |
| JP | 11 184300 | 7/1999 |
| JP | 2001 083832 | 3/2001 |
| JP | 2002 014564 | 1/2002 |
| JP | 2002 091222 | 3/2002 |
| JP | 2002 123089 | 4/2002 |
| JP | 2002 148984 | 5/2002 |
| JP | 2002 091221 | 3/2003 |
| JP | 2003 076201 | 3/2003 |
| JP | 2003 107947 | 4/2003 |

(Continued)

*Primary Examiner* — Quana M Grainger
(74) *Attorney, Agent, or Firm* — Oblon, Spivak, McClelland, Maier & Neustadt, L.L.P.

(57) ABSTRACT

A fixing device (55) including a fixing member (6), a pressure member (7) forcibly contacting with the fixing member, and a separating plate (1) for separating a transfer paper (9) ejected from a nipping part (8) formed by the fixing member and the pressure member contacting with the fixing member, from the fixing member, the separating plate including an edge part (2) disposed close to the fixing member, the separating plate being disposed relative to the fixing member so that a sum of a thickness of the edge part of the separating plate and a gap (10) formed between the edge part and the fixing member is lesser than a minimum lift height of the transfer paper ejected from the nipping part.

16 Claims, 7 Drawing Sheets

FOREIGN PATENT DOCUMENTS

| | | |
|---|---|---|
| JP | 2003 122173 | 4/2003 |
| JP | 2003 122174 | 4/2003 |
| JP | 2003 122175 | 4/2003 |
| JP | 2003 186336 | 7/2003 |
| JP | 2001 235959 | 8/2003 |
| JP | 2003 263059 | 9/2003 |
| JP | 2003 263061 | 9/2003 |
| JP | 2004 109636 | 4/2004 |
| JP | 2004 184456 | 7/2004 |
| JP | 2004 191405 | 7/2004 |
| JP | 2004 205751 | 7/2004 |
| JP | 2004 233966 | 8/2004 |

* cited by examiner

SEPARATING PLATE, FIXING DEVICE HAVING THE SEPARATING PLATE WITH AN EDGE PART THAT ABUTS WITH THE FIXING MEMBER, METHOD FOR PRODUCING THE SEPARATING PLATE AND IMAGE FORMING APPARATUS

CROSS-REFERENCE TO RELATED APPLICATION

This application is based on Japanese Patent Application No. 2004-366252 filed on Dec. 17, 2004, the contents of which are incorporated herein by reference.

TECHNICAL FIELD

The present invention relates to a separating plate used to separate a transfer paper from a fixing member in an electro-photographic type-image forming apparatus such as copying machines, printers, facsimiles or the like, a fixing device having the separating plate, a method for producing the separating plate and an image forming apparatus including the separating plate or the fixing device.

BACKGROUND ART

An apparatus using an electro-photographic type, for example, a laser printer has a rotatable photoconductive drum and forms an electrostatic latent image by exposing a photoconductive layer on the photoconductive drum by a laser beam from a laser scanning unit after the photoconductive layer on the photoconductive drum is charged uniformly.

In addition, the laser printer is configured to form a toner image by developing the electrostatic latent image by a toner, transfer the toner image on a transfer paper, and then fix the toner image thermally by passing the transfer paper through a thermal fixing device.

Such a conventional thermal fixing device uses a fixing roller including an anti-sticky layer such as fluorine resin to prevent an adhesive of a toner on an outer peripheral surface of a cored bar of a hollow cylinder made of, for example, aluminum, or the like.

The fixing roller is configured to dispose a heater such as a halogen lamp in the hollow cored bar along a rotational central axis of the roller and heat the fixing roller from an inside thereof by radiant heat of the heater.

Furthermore, by providing a fixing roller and a pressure roller contacting with the fixing roller and passing a transfer paper between the fixing and pressure rollers, while melting a toner adhered on the transfer paper by heat of the fixing roller, the toner is transferred on the transfer paper by pressuring. At this time, because the transfer paper is ejected in such a manner that the toner melts and fits closely to the fixing roller, a separating pawl made of a heat-resistant resin such as polyimide, polyamide-imide, PPS (polyphenylene sulfide), or the like is provided to abut with the fixing roller in order to separate the transfer paper from the fixing roller or fixing belt.

In recent, with colorization of images, as a method of fixing a transfer paper in which several colored toners are laminated, a fixing belt including a belt made of a metal or polyimide, an elastic layer of silicon rubber formed on the belt, and an adhesion-preventing layer of a fluorine resin formed on the elastic layer to prevent the adhesion of the toner has been used.

In a fixing belt or fixing roller using a color toner, when the separating pawl is abutted with the elastic layer, the separating pawl bites in the elastic layer there is a problem that the elastic layer, separating pawl or the like is damaged. Therefore, a peeling sheet pr separating plate which does not contact with the elastic layer has bee used.

Conventionally known are various technologies for separating a transfer paper from a fixing member such as a fixing roller or fixing belt.

Japanese Patent Laid-Open No. 2001-83832 discloses a peeling sheet for peeling a recording paper ejected from a nipping part between a fixing roller and a pressure roller from the fixing roller. The peeling sheet is formed from a thin metallic plate and includes an edge having a continuous curvature, and the edge is covered with a coating layer of a fluorine resin having mold-releasing property.

Japanese Patent Laid-Open No. 2002-91222 discloses a peeling member including a supporting member, a peeling sheet connected with the supporting member by a sheet laser spot welding, and a fluorine resin sheet attached to a portion of the peeling sheet close to the fixing roller.

Japanese Patent Laid-Open No. 2004-109636 discloses a separating pawl configured to abut with a fixing roller for contacting with a pressure roller. The separating pawl is disposed so that an angle at which a line connecting centers of the fixing and pressure rollers and a line connecting the center of the fixing roller and a contacting point of the separating pawl with the fixing roller are disposed is set at 40° or less.

In addition, Japanese Patent Laid-Open No. 2003-122175 discloses that when a leading end of a transfer paper passes a separating member contacting with a fixing member, the separating member is moved.

However, in the peeling sheet disclosed in Japanese Patent Laid-Open No. 2001-83832, because the thin metallic plate is bent in a predetermined shape, thereafter the fluorine resin is coated on the bent plate, there is a problem that deformation, bow, damage at a bent portion or the like occurs in the bent plate due to a relatively high baking temperature for the fluorine resin, and therefore a stable gap between the peeling sheet and the fixing roller is not obtained.

Also, in Japanese Patent Laid-Open No. 2002-91222, because the fluorine resin sheet is attached to the peeling sheet by an adhesive, there is a problem requiring some processes such as carrying out a surface treatment such as etching on the peeling sheet, thereafter applying the adhesive to the peeling sheet, after heating and drying it, attaching the fluorine resin sheet to the peeling sheet.

Moreover, in Japanese Patent Laid-Open No. 2004-109636, because the separating pawl contacts with the fixing roller, there is a problem that the separating pawl causes damage to fixing roller.

Furthermore, in Japanese Patent Laid-Open No. 2003-122175, because a moving mechanism to move the separating plate is required, there is a problem that a structure is complicated.

DISCLOSURE OF INVENTION

An object of the present invention is to provide a separating plate capable of separating efficiently a transfer paper from a fixing member such as a fixing belt or fixing roller without requiring a complicated process and assembling accuracy, and generating a damage in the fixing member, a fixing device having the separating plate, a method for producing the separating plate and an image forming apparatus including the separating plate or the fixing device.

To accomplish the above-mentioned object, a separating plate according to one embodiment of the present invention is configured to separate a transfer paper ejected from a nipping part formed by a fixing member and a pressure member contacting with the fixing member, from the fixing member.

The separating plate includes an edge part disposed close to the fixing member.

The separating plate is disposed relative to the fixing member so that a sum of a thickness of the edge part of the separating plate and a gap formed between the edge part and the fixing member is lesser than a minimum floating amount of the transfer paper ejected from the nipping part.

BEST MODE FOR CARRYING OUT THE INVENTION

Hereinafter, a best mode for carrying out the present invention will be explained based on some embodiments with reference to the accompanying drawings.

Figure 1:
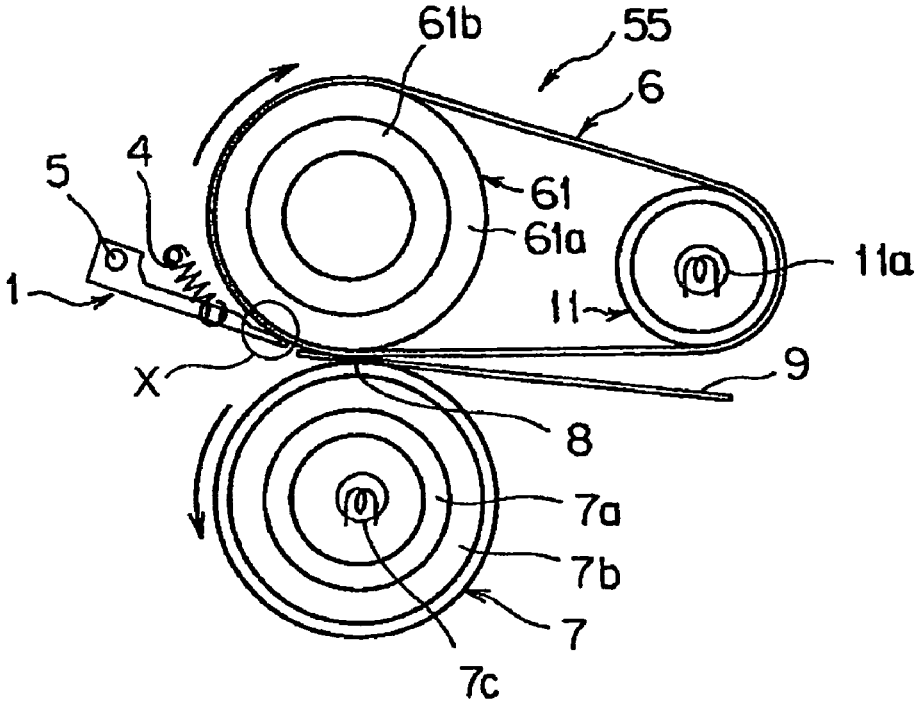
FIG. 1 is a side elevational view showing one embodiment of a fixing device according to the present invention.

FIG. 1 illustrates one embodiment of a fixing device according to the present invention. As shown in FIG. 1, the fixing device 55 includes a fixing roller 61, a heating roller 11, a fixing member, for example, a fixing belt 6 wound around the fixing roller 61 and the heating roller 11, a pressure member, for example, a pressure roller 7 for pressing the fixing belt 6 and a transfer paper 9 disposed on the fixing belt to the fixing roller 61, and a separating plate 1 for separating the transfer paper 9 from the fixing member or fixing belt 6.

The fixing roller 61 and the pressure roller 7 hold the transfer paper 9 at a nipping part 8 formed between the fixing roller 61 and the pressure roller 7.

The fixing roller 61 includes a cored bar 61*a* and an elastic layer 61*b*. The pressure roller 11 has a heat source 11*a* such as a halogen heater or the like disposed therein. The fixing belt 6 includes a base member 6*b* and a mold releasing layer 6*a* (see FIG. 2). The pressure roller 7 includes a cored bar 7*a*, an elastic layer 7*b*, and a heat source 7*c* disposed in the pressure roller 7.

The fixing device 55 includes a separating plate 1 for peeling the transfer paper 9 closely fitted on the fixing belt 6 by the fixed toner on the transfer paper the from the fixing belt when the fixed transfer paper 9 is ejected from the nipping part 8 formed by the fixing belt 6 and the pressure roller 7.

Figure 4A:
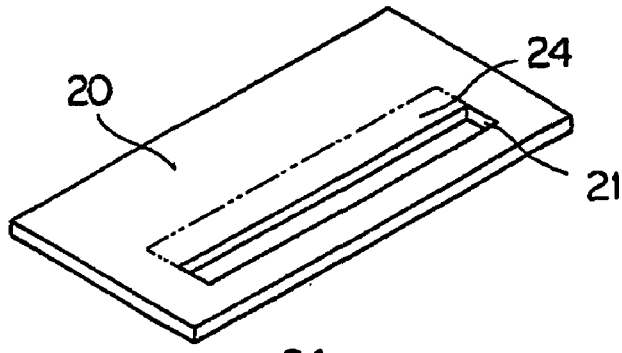
FIGS. 4A to 4E are process views showing a method for producing a separating plate in the fixing device according to the present invention.
Figure 4B:
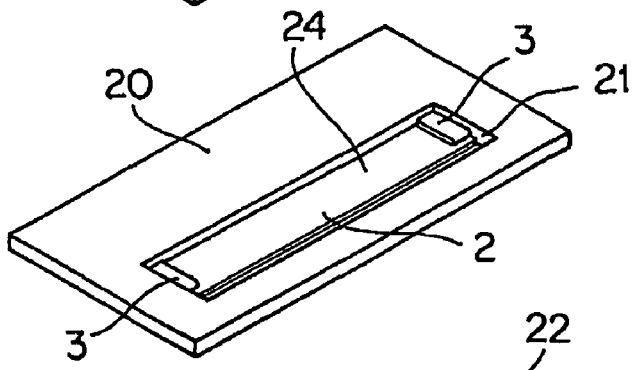
Figure 4C:
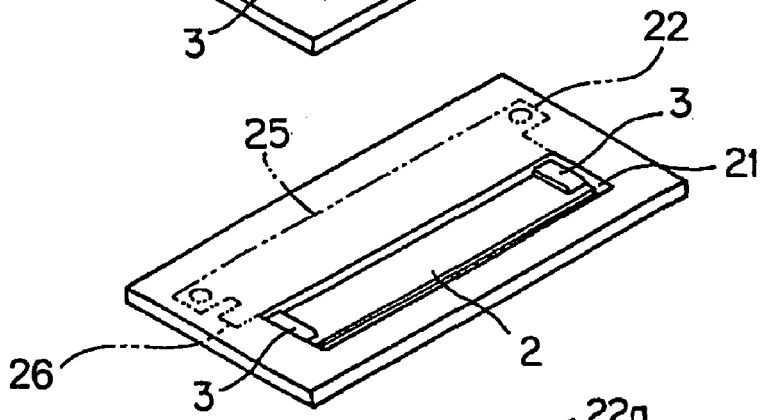
Figure 4D:
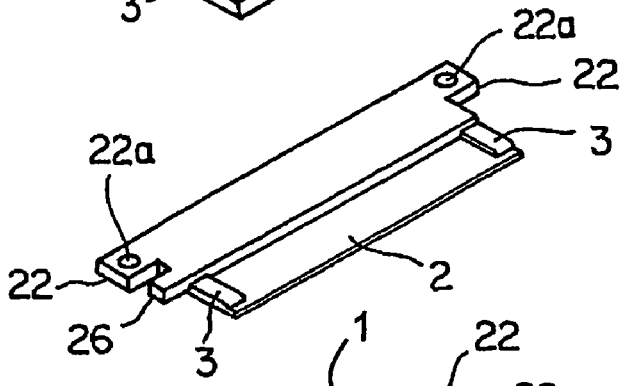
Figure 4E:
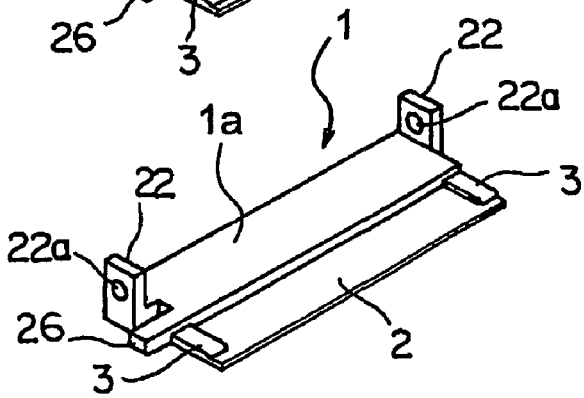

The separating plate 1 has a structure shown in FIG. 4E, for example. In this embodiment, the separating plate 1 is integrally formed by a metallic plate such as iron, stainless steel and aluminum or the like by means of, for example, a rolling. The separating plate 1 has an elongate rectangular basic part 1*a*, an edge part 2 extending from one side edge of the basic part 1*a*, and supporting portions 22 provided to extend approximately perpendicularly to a surface of the basic part from opposite sides of the basic part.

Mounting holes 22*a* passing through a mounting shaft 5 are provided in the supporting portions 22.

The separating plate includes abutting parts 3 which are provided on areas where the transfer paper 9 does not pass, for example, opposite sides of the edge part 2 to contact with a surface of the fixing belt 6 (see FIG. 4E).

The supporting parts 22 of the separating plate 1 are rotatably attached to a suitable mounting part (not shown) through the mounting shaft 5 so that the edge part 2 approaches to the fixing belt 6 and separates from the fixing belt 6.

The separating plate 1 is rotated about the mounting shaft 5 so that the abutting parts 3 are contacted elastically with the surface of the fixing belt 6 by a biasing force of a spring 4 (see FIG. 1).

Figure 2:
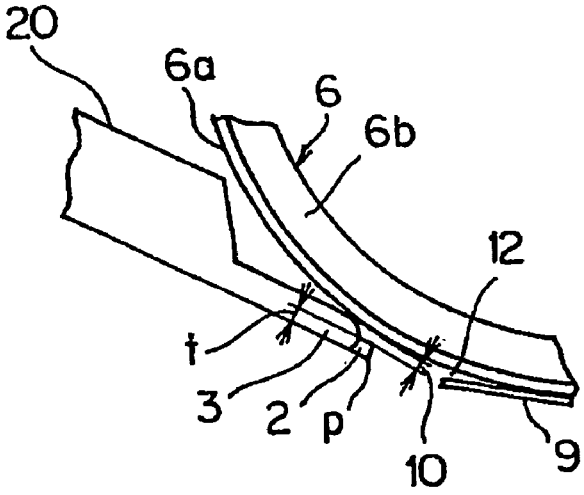
FIG. 2 is an enlarged view of an X portion in FIG. 1.

When the abutting parts 3 of the separating plate 1 contact with the fixing belt, a gap having a predetermined dimension is established between the leading end, in other words, a tip p of the edge part 2 and the surface of the fixing belt (see FIG. 2). A thickness f (see FIG. 2) of the edge part 2 is set to be a predetermined size, as described below.

As shown in FIG. 2, the transfer paper 9 is ejected from the nipping part 8 so that the leading end of the transfer paper 9 lifts from the surface of the fixing belt 6 slightly.

Figure 3:
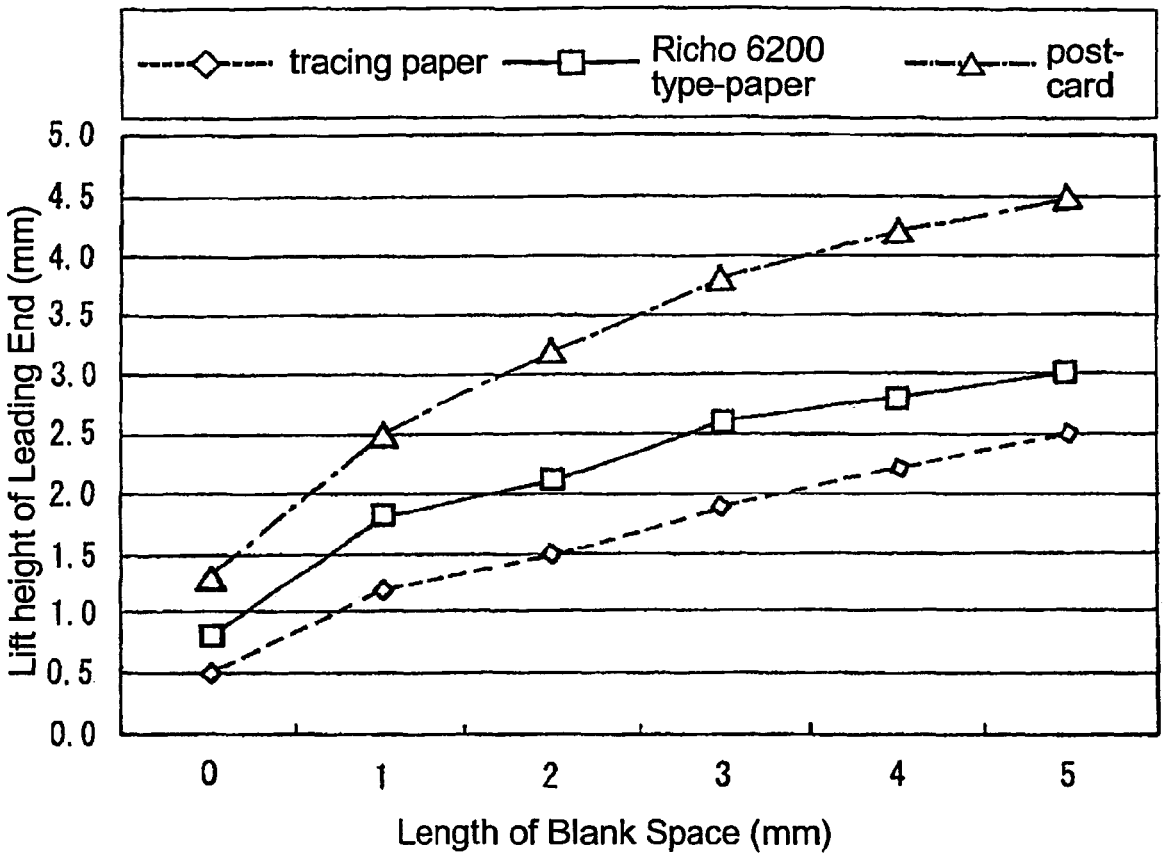
FIG. 3 is a graph showing a relationship of a length of blank space of a transfer paper and a lift height of a leading end of the transfer paper.

FIG. 3 illustrates a relationship of a length of blank space of the transfer paper 9 and a lift height of the leading end of the transfer paper 9. A relationship of a length of blank space at the leading end of each of three kinds of transfer papers 9 and a lift height 12 of the leading end of each transfer paper right after the transfer paper is ejected from the nipping part 8 is shown in FIG. 3.

In this example, as the three kinds of transfer papers, a tracing paper shown by a broken line, a Ricoh 6200 type-paper shown by a solid line, and a postcard shown by a chain line are used.

As is clear from FIG. 3, a relatively thick paper tends to separate from the surface of the fixing belt, on the contrary, a thin paper is easy to closely fit to the surface of the fixing belt. This difference results from a hardness of a paper.

In this way, because the leading end of the transfer paper 9 ejected from the nipping part 8 lifts, if the edge part 2 of the separating plate 1 gets enters a gap between a lifted part and the fixing belt 6, it is possible to separate the transfer paper 9 from the surface of the fixing belt 6.

Here, as one example, the lift height or amount is determined based on empirical rule from a kind of the transfer paper.

In order to achieve smoothly the movement of the edge part 2 into the gap, a distance between the surface of the fixing belt 6 and the tip p of the edge part 2 of the separating plate 1 facing the fixing belt 6 is set to be lesser than a lift amount or lift height 12 of the transfer paper 9, which is obtained based on the kind and the blank space of the transfer paper 9 to be sent.

In other words, the separating plate is disposed relative to the fixing member so that a sum of a thickness of the edge part 2 of the separating plate 1 and a gap formed between the edge part and the fixing member is lesser than a minimum lift height of the transfer paper 9 ejected from the nipping part 8.

The gap 10 is set by suitably adjusting a thickness of the abutting pats 3 in accordance with the thickness of the edge part 2.

The adjustment of thickness of the abutting parts can be achieved when a process for producing the separating plate is executed as described below.

FIGS. 4A to 4E illustrate one embodiment of a method for producing the separating plate according to the present invention, and FIG. 5 illustrates one example of a rolling process in the producing method, as shown in FIGS. 4A to 4E.

The process for the producing method includes a slitting step as shown in FIG. 4A, a rolling step as shown in FIG. 4B, a step for forming an outer periphery of the separating plate as shown in FIG. 4C, a punching step as shown in FIG. 4D, and a bending step as shown in FIG. 4E.

More specifically, the process for producing the separating plate first includes a step for forming a rectangular slit 21 close to a location of a blank 20 corresponding to the edge part 2 of the separating plate 1 (slitting step), as shown in FIG. 4A. In one example, the blank 20 comprises a metallic plate made of iron, stainless steel, aluminum or the like.

Next, a rolling area 24 or location corresponding to the edge part 2 as shown in FIG. 4A is rolled to form the edge part 2 and the abutting parts 3 (rolling step), as shown in FIG. 4B.

Figure 5A:
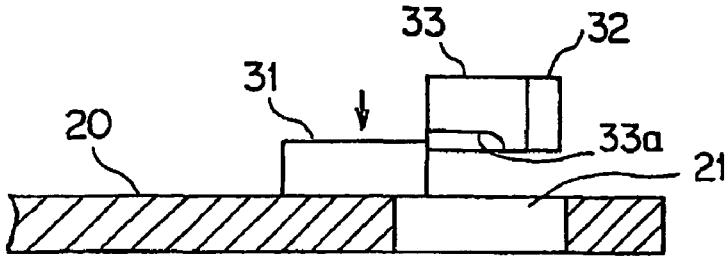
FIGS. 5A to 5F are process views showing one example of a rolling process in the producing method shown in FIGS. 4A to 4E.
Figure 5B:
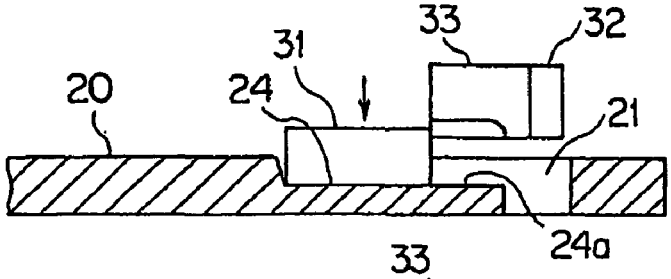

In the rolling step, the rolling area 24 is first rolled by a first press die 31 of a hydraulic pressing machine depending on a length and a thickness of the edge part 2, as shown in FIGS. 5A and 5B.

Meanwhile, the hydraulic pressing machine includes the first pressing die 31, a second pressing die 32, a third pressing die 33, and a pressing die 34 for punching. The third pressing die 33 has a surface 33*a* for forming a semi-circular shape.

In general, the ability of the pressing machine is determined by a load for pressing. When the blank 20 of a metallic plate having the thickness of 16 mm is rolled into the edge part 2 having the thickness of 0.2 mm, a plurality of times of rolling steps are applied to the blank by use of a die in a pressing machine having the ability of 150 to 500 tons to form the edge part 2 having a predetermined thickness.

If a pressure loading of the pressing machine is greater, the predetermined thickness of the edge part can be obtained with lesser times of rolling steps.

Figure 5C:
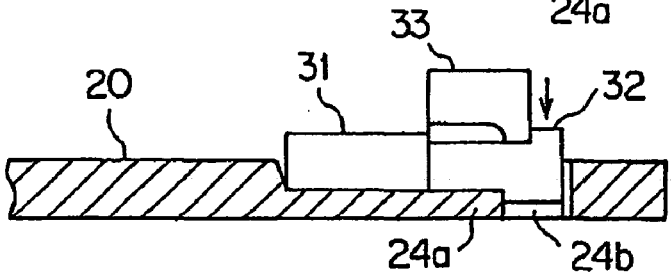
Figure 5D:
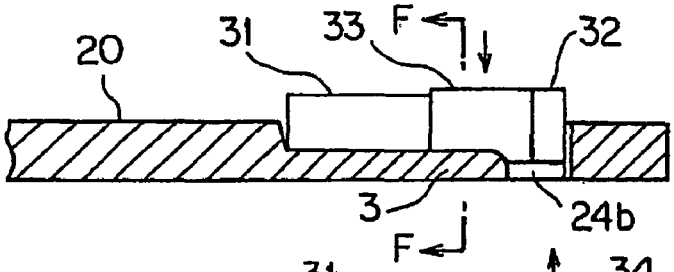

Next, as shown in FIG. 5C, a thickness of a rolled portion for forming the edge part, which is formed into the edge part 2 in an after step is rolled into a predetermined thickness by use of the second pressing die 32, thereafter, portions of the blank corresponding to the abutting parts 3 are rolled by use of the third pressing die 33, as shown in FIG. 5D.

At this time, the abutting parts 3 are set to have a thickness adding the gap 10 to the thickness of the edge part 2 by the rolling.

In addition, abutting portions of the abutting parts with the surface of fixing belt 6 are configured to have curved surfaces, as shown in FIG. 5D so that the abutting portions can be contacted with the surface of the moving fixing belt 6 without scratching on the surface of the fixing belt 6.

Figure 5E:
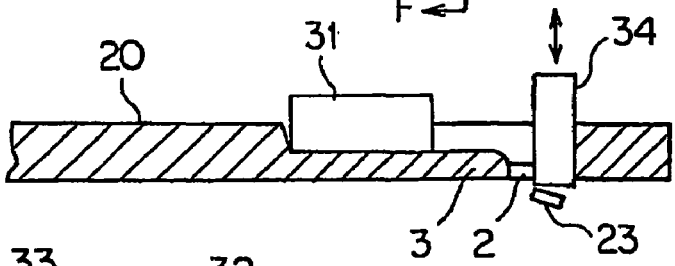
Figure 5F:
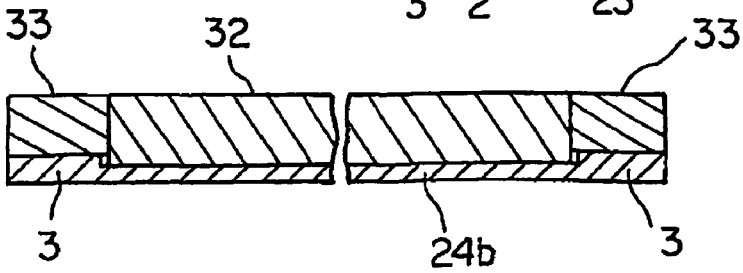
Figure 6A:
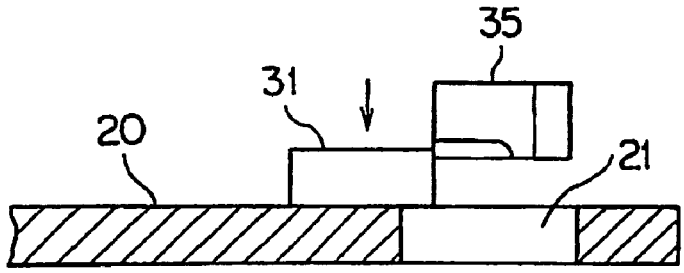
FIGS. 6A to 6E are process views showing another example of the rolling process in the producing method shown in FIGS. 4A to 4E.
Figure 6B:
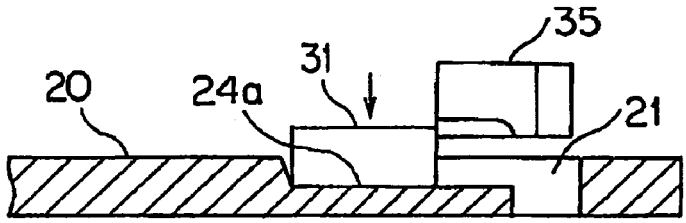
Figure 6C:
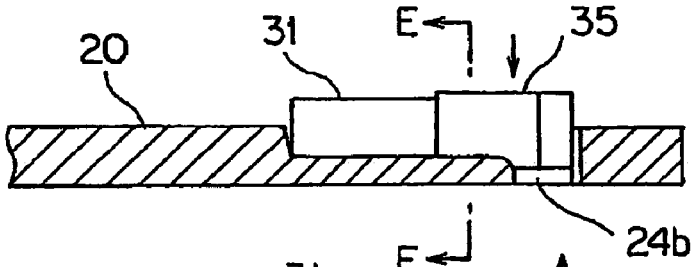
Figure 6D:
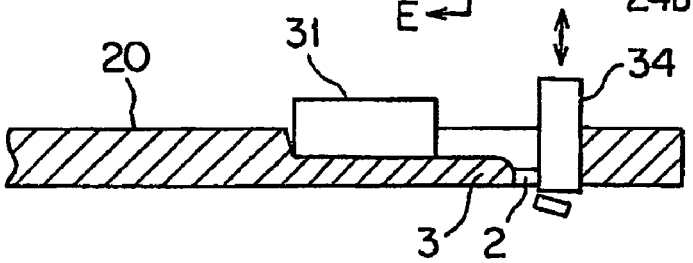
Figure 6E:
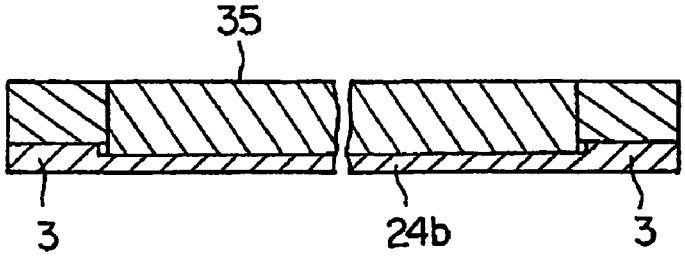

Subsequently, as shown in FIG. 5E, the edge part 2 is formed by a pressing die 34 so as to punch out or remove an excess portion 23 of the edge portion 2 extended by the rolling from the edge part 2. In this formation, it is possible to remove a burr tending to generate at the leading end of the edge part 2 by repeatedly upwardly and downwardly moving the punching die 34. In addition, the burr may be removed in an after step.

Next, as shown in the outer peripheral processing step in FIG. 5C and the punching out step in FIG. 5D, an outer periphery of the supporting portions 22 for supporting the mounting shaft 5 and an engaging part 26 for supporting the spring 4 is punched out along a punching out line 25, and after punching out the outer periphery, then the supporting portions 22 are formed by approximately perpendicularly bending them through the bending step as shown in FIG. 5E.

The material and thickness of the blank 20 may be decided optionally based on a necessary stiffness depending on a moving speed and a passing width of the transfer paper 9. In particular, if the thickness of the edge part 2 is less than 0.1 mm, a corrugation or crack may be generated at the tip of the edge part.

If the thickness of the edge part 2 exceeds 0.5 mm, there is a limitation that a blank space must be provided on the tracing paper as shown in FIG. 3. Therefore, a range of 0.1 to 0.5 mm as the thickness t of the edge part 2 is appropriate.

As mentioned above, after the separating plate 1 is formed from the blank 20 by the pressing machine, a fluorine resin is covered on a surface of the separating plate 1 to prevent the attachment of a toner thereto right after fixation thereof.

The separating plate 1 has no function for melting the toner and attaching the melted toner to the transfer paper 9 at the nipping part 8.

A sufficient mold releasing force is not required for the separating plate 1 to achieve the function for preventing the adhesion of the toner, but it is preferable for the separating plate to form a more smoothly flat contacting surface to move smoothly the transfer paper 9 without generating orange peel or protrusions on a surface of the fluorine resin, which prevent the passing of the transfer paper.

As a result of reviewing the fluorine resin with a focus on the above, the mold releasing layer of the fixing belt or fixing roller, which is made of a material including a fluorine resin of 50 to 70 weight percents is better than as in a material including a fluorine resin of 100 weight percents in mold-release property and heat-flowability.

In addition, a primer layer is not required for the separating plate 1 by adding polyimide or polyamide-imide having an increased adhesiveness to the blank 20 to the material and a smoothly flat surface can be obtained for the separating plate 1.

For the fluorine resin, PTFE (polytetrafluoroethylene), PFA (tetrafluoroethylene-perjluoroalkylvinylether-copolymer), FEP(tetrafluoroethylene-hexafluoroethylene-copolymer) or the like are listed as typical materials, while the fluorine resin has a high cohesive force and an insufficient dispersibility, therefore it requires a binder and occurs a spherical crystal when it is sintered, and hence has no a smooth surface.

Generally, if a fluorine resin layer is covered on the fixing roller, a finishing process such as a polishing or the like is required. In view of the fact and the function of the separating plate 1, it is possible to omit a primer or finishing process by suitably setting the mold releasing layer.

The coating of the fluorine resin is also formed on a surface where the transfer paper 9 passes. The surface where the transfer paper 9 passes means an outer corner portion or the tip p of the edge part 2, with which the transfer paper 9 ejected from the nipping part 8 contacts. Moreover, a coating is formed on each of the curved surfaces of the abutting parts 3. That is to say, in the separating plate 1, the portions contacting with the fixing belt 6 and the transfer paper 9 are coated.

In the rolling steps as shown in FIGS. 5A to 5F, although the edge part 2 is processed by rolling, thereafter the abutting parts 3 are processed by rolling, the edge part 2 and the abutting parts 3 may be simultaneously roll-processed by a fourth pressing die 35 which is configured by integrating the second and third pressing dies 32 and 33 as shown in FIG. 5 (see FIG. 6).

In the rolling steps as shown in FIGS. 6A to 6E, the edge part and the abutting parts can also be simultaneously processed by use of the fourth pressing die 35, similarly to the above-mentioned process.

In addition, instead of the rolling process of the abutting parts 3 after the edge part 2 is processed by rolling, after the abutting parts 3 are processed by rolling, the edge part 2 may be processed by rolling.

Subsequently, a further detailed process for producing the separating plate 1 is explained as follows.

A hot dip galvanized steel plate (SGCD 1) having the thickness of 1.6 mm and the size of 400 mm by 200 mm as the material of the separating plate 1 is first prepared. In the embodiment, a rectangular slit 21 having the width of 5 mm is provided close to one side of the rolling area or location 24 corresponding to the edge part 2 in the steel plate by use of the high-flex press-NS2300 tons made by Ida Engineering Co, Ltd, as shown in FIGS. 4A and 5A.

One portion of the location 24 throughout the width of about 3 mm from one edge of the slit 21 is then rolled to form the abutting parts 3 having the thickness of about 0.35 mm (see FIGS. 4B, 4C and 5B).

Next, an area of the location 24 other than the abutting parts 3 is further rolled to form the edge part 2 having the thickness of 0.2 mm (see FIGS. 4B, 4C, 5C and 5D), and further the excess portion 23 of the edge part 2 is removed (see FIG. 5E), thereby the edge part 2 having the abutting parts 3 is completed.

Subsequently, the outer periphery of the supporting portions 22 and the engaging part 26 is punched out along the punching out line 25 (see FIGS. 4C and 4D), and then the supporting portions 22 are bent perpendicularly (see FIG. 4E), thereby the separating plate 1 is completed as shown in FIG. 4E.

Next, a fluorine-resinous paint including in solid content proportion, 60 weight percents of PTFE resin, 35 weight percents of polyimide resin, and 5 weight percents of a carbon black as an additive is sprayed on all surfaces of the separating plate where the transfer paper 9 passes, and the rolled part including the edge part 2 and the abutting parts 3 by a spray painting, after it is dried at 150° C., the separating plate is kept in an ambience of 360° C. for 20 minutes, thereby a coating of fluorine resin is completed by such a baking.

The separating plate 1 produced as the mentioned above was installed on a fixing unit in a color printer "IPSIO8000" made by Ricoh Co, Ltd, instead of a separating pawl (comparative example 1) which is mounted on the fixing unit and made of polyimide resin, and a test passing transfer papers was executed.

In the installation of the separating plate 1, the abutting parts 3 of the separating plate 1 were abutted with the both side areas of the fixing belt 6 where the transfer papers do not pass by pivoting the mounting shaft 5 having a diameter of 6 mm on both side plates of the fixing unit and by providing the spring 4 while setting a force similar to the presently set contacting load 0.25 N of the conventional separating pawl.

The thickness of the edge part 2 of the separating plate 1 was set to be 0.2 to 0.23 mm, and the gap was set to be 0.13 to 0.16 mm.

Moreover, as a comparative example 2, similarly to the method for producing the supporting member disclosed in Japanese Patent Laid-Open 2002-91222, a hot dip galvanized steel plate having the thickness of 1.6 mm is first connected to a similar hot dip galvanized steel plate having the thickness of 0.2 mm by a laser spot welding, thereafter, a silicon system-primer agent is then sprayed to the connected member, after it is dried at 150° C., a fluorine resin tape is attached to a leading end of the edge part 2 to surround the leading end from a surface facing the transfer paper to the opposite back surface.

The separating plate produced in this way is mounted on the fixing unit similarly as in the above, and a test for passing transfer papers was executed.

The results of the test are shown in a table 1 which is incorporated herein. As is clear from the table 1, various kinds of transfer papers 9 can be separated without generating abnormal images and life duration of the fixing belt 6 can be increased by the structure of the separating plate 1 as shown in the above-mentioned embodiments according to the present invention, compared with the conventional contact-type separating pawl.

TABLE 1

| separating type | kind of transfer paper | initial feeding quality number of occurrence of jam | time lapse-image quality after feeding of five ten-thousand Ricoh 6200 type-papers | durability of fixing belt Ricoh 6200 type transfer paper | determination |
|---|---|---|---|---|---|
| embodiment | tracing paper | no occurrence three times about continuous feed of one-hundred papers per one time | good | no occurrence break of surface and removal of film of fixing belt in continuous feed of fifteen ten-thousand papers | ○ |
| | Ricoh 6200 type | no occurrence three times about continuous feed of one-hundred papers per one time | | | |
| | post card | no occurrence three times about continuous feed of fifty papers per one time | | | |
| comparative example 1 separating pawl type | tracing paper | no occurrence three times about continuous feed of one-hundred papers per one time | occurrence of abnormal image by friction of fixing belt by separating pawl | occurrence break of surface of fixing belt by separating pawl in continuous feed of one hundred-thousand papers | X |
| | Ricoh 6200 type | no occurrence three times about continuous feed of one-hundred papers per one time | | | |
| | post card | no occurrence three times about continuous feed of fifty papers per one time | | | |

TABLE 1-continued

| separating type | kind of transfer paper | initial feeding quality number of occurrence of jam | time lapse-image quality after feeding of five ten-thousand Ricoh 6200 type-papers | durability of fixing belt Ricoh 6200 type transfer paper | determination |
|---|---|---|---|---|---|
| comparative example 2 type of welding leading end to supporting member | tracing paper | no occurrence three times about continuous feed of one-hundred papers per one time | occurrence lifting of fluorine resin sheet occurrence of abnormal image by fixing of toner at lifting part | no occurrence break of surface and removal of film of fixing belt in continuous feed of fifteen ten-thousand papers | X |
| | Ricoh 6200 type | no occurrence three times about continuous feed of one-hundred papers per one time | | | |
| | post card | no occurrence three times about continuous feed of fifty papers per one time | | | |

Figure 7A:
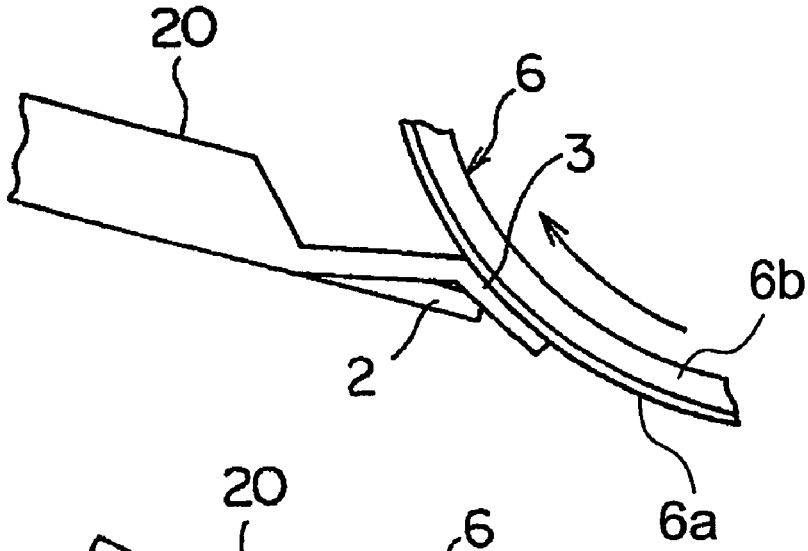
FIG. 7A is a partial side elevational view showing a modified example of abutting parts.
Figure 7B:
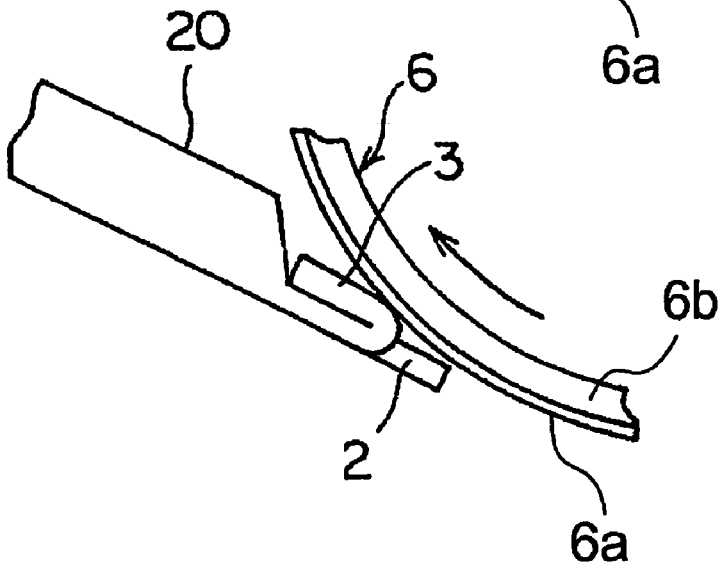
FIG. 7B is a partial side elevational view showing a further modified example of the abutting parts.

In the above-mentioned embodiments, the abutting parts 3 and the edge part 2 are formed by the rolling process to have a step between the abutting parts and the edge part. However, the leading ends of the abutting parts 3 may be provided by bending them to contact with the fixing belt 6 tangentially, as shown in FIG. 7A or turning over the leading ends to face the fixing belt 6 or inwardly, as shown in FIG. 7B, thereby the step between the edge part 2 and the abutting parts 3 is formed.

The shape of the abutting parts may be selected optionally depending on a curvature of the fixing belt 6, a setting position of the separating plate 1, and a speed at which the transfer paper 9 is ejected.

Figure 8:
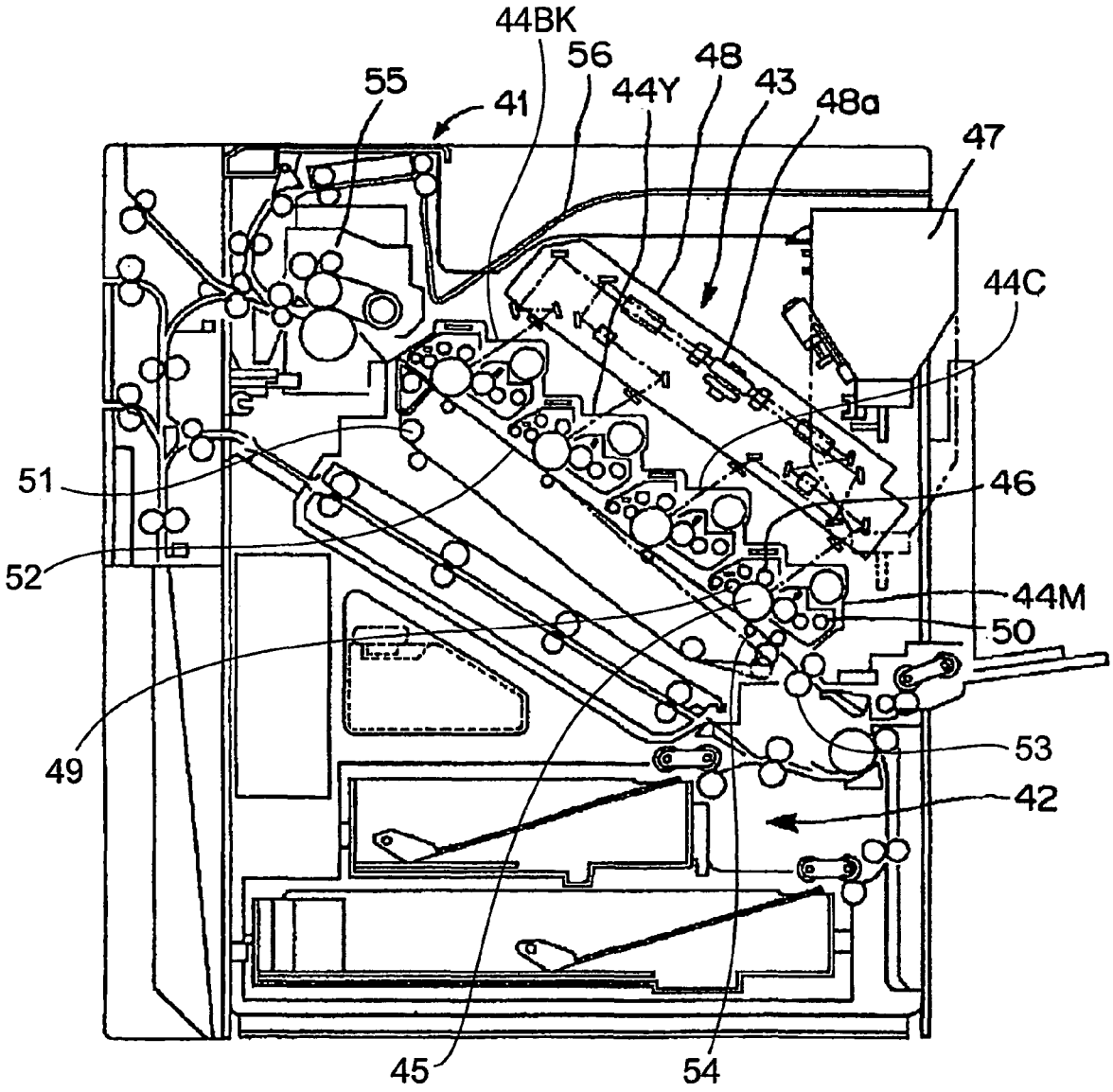
FIG. 8 is a schematic structural view of an image forming apparatus according to the present invention.

FIG. 8 illustrates a full color laser printer which is a color image forming apparatus to which the fixing device according to the present invention is applied.

The above-mentioned color laser printer has a structure in which upwardly and downwardly disposed paper feeders 42 are disposed downwardly of a main body 41 and an image forming part 43 is disposed above the feeders 42. In the printer, it is possible to use as a sheet-shaped medium any of a standard paper used for a usual copy or the like, and a special paper having a heat capacity greater than that of the standard paper and including an OHP sheet, a 90 K paper such as a card and a post card, a thick paper of basis weight, about 100 g/m2 or more, and an envelope or the like.

In addition, provided in the image forming part 43 is a transfer belt device which is disposed obliquely so that a feeding portion thereof is downwardly disposed and an ejecting portion thereof is upwardly disposed. The transfer belt device has an endless transfer belt 52 which is wound around a plurality of rollers 51, in the illustrated embodiment, four rollers 51 and rotated by driving one roller 51 by means of a drive source (not shown).

Four image forming units 44M, 44C, 44Y and 44BK for magenta (M), cyan (C), yellow (Y) and black (BK) are arranged on an upper traveling section of the transfer belt 52 in sequence from below.

A photoconductor 45 as an image carrier is provided on each of the image forming units 44M, 44C, 44Y and 44BK.

The photoconductor 45 is configured to be rotated clockwise as viewed in FIG. 8 by a drive device (not shown). A charging roller 46 as a charging device, a light writing section configured to achieve the writing of a laser beam by a light writing device 48, a developing device 50, and a cleaning device 49 are provided in a periphery of the photoconductor 45.

Each of the developing devices 50 comprises a two ingredient developing device to which a toner is supplied by a toner supplying device which will be described below in accordance with a consumed amount of toner.

Next, an operation foe carrying out a full color print by the color printer having the structure as mentioned above is explained based on the image forming unit 44 M for magenta.

A light image developed by a magenta toner is written on the photoconductor 45 charged by the charging roller 46 by means of the light writing device 48 which illuminates a laser beam to a polygon-miller 48*a* driving an LD (laser diode) (not shown) and guides light reflected on the polygon-miller through a cylindrical lens or the like to the photoconductor 45. By the light writing, an electrostatic latent image based on image data sent by a host machine such as a personal computer or the like is formed on the photoconductor 45 and the latent image becomes a visible image by the toner in the developing device 50.

On the other hand, each of sheet-shaped media designated as transfer papers is supplied from each of the paper feeders 42, the supplied sheet-shaped medium is abutted once with a resist roller 53 provided at an upper stream in a direction of movement of the transfer belt 52, thereafter, it is supplied on the transfer belt 52 so as to synchronize with the visible image, and reaches a transfer position facing the photoconductor 45 by the movement of the transfer belt 52.

In this transfer position, the visible image of the magenta toner is transferred on the sheet-shaped medium by operation of the transfer roller 54 disposed to face a back side of the transfer belt 52.

Similarly to the above, the visible image of each toner even in each of the other image forming units 44C, 44Y, and 44BK is formed on a surface of the respective photoconductor 45, these visible images are overlapped and transferred every the time that the sheet-shaped medium transported by the transfer belt 52 reaches each transfer position.

Therefore, in the color printer, the full color image is overlapped and transferred on the sheet-shaped medium in a short time, similarly to a mono-color image. The sheet-shaped medium after the transfer is separated from the transfer belt 52 and fixed by a fixing device 55. After the fixing is completed, the sheet-shaped medium is ejected out of the image forming apparatus usually directly, while, the sheet-shaped medium is then turned over and ejected on an ejected tray 56 provided on an upper surface of the main body 41.

Meanwhile, although the fixing device 55 shown in FIG. 8 has a thermal belt type, it may be structured to have a heating roller type.

In each of the above-mentioned developing devices 50, a mixing ratio of the toner and a carrier in the apparatus is monitored, if the toner is insufficient, an insufficient amount of the toner is supplemented.

The supplementation of toner is accomplished by supplying the toner contained in a toner container 47 or toner containing device disposed at a position remote from the developing devices 50, in this embodiment, in a right and above position as shown in FIG. 8 to the developing devices 50 through the toner supplying device. One toner container 47 is illustrated in FIG. 8, but actually four toner containers are provided according to the four developing devices, three toner containers are omitted in FIG. 8.

In addition, although the some embodiments have been described, the present invention is not limited to the above-mentioned embodiments. For example, the fluorine resin coating is used as the mold-releasing material, but a fluorine resin sheet may be attached to the separating plate.

According to the present invention, the transfer paper can be separated from the fixing member efficiently without requiring a complicated process or assembly and damaging the fixing member such as the fixing roller or fixing belt, and hence jam or the like of the fixing member and so on can be prevented, and life duration of the fixing member can be increased.

INDUSTRIAL APPLICABILITY

In the above-mentioned embodiments, although the separating plate according to the present invention is applied to the image forming apparatus such as the printer or the like, without being limited to this, for example, the separating plate may be used as a scraper aligning powder.

The invention claimed is:

1. A separating plate for separating a transfer paper ejected from a nipping part formed by a fixing member and a pressure member contacting with the fixing member, from the fixing member, wherein the separating plate comprises an edge part disposed close to the fixing member, and abutting parts provided on areas of the edge part where the transfer paper does not pass and configured to be in contact with the fixing member to form a gap between the edge part and the fixing member, the abutting parts being disposed downstream of the edge part in a moving direction of the fixing member, wherein the abutting parts include bent portions having contacting surfaces which contact in a tangent direction with a circumference surface of the fixing member at opposite side portions thereof, wherein the separating plate is disposed relative to the fixing member so that a sum of a thickness of the edge part of the separating plate and the gap between the edge part and the fixing member is less than a minimum lift height of the transfer paper ejected from the nipping part.

2. The separating plate according to claim 1, wherein a thickness of the edge part has a range of 0.1 to 0.5 mm.

3. The separating plate according to claim 1, wherein a mold-releasing member is disposed on an area of the edge part where the transfer paper passes.

4. The separating plate according to claim 3, wherein the mold-releasing member comprises one layer formed from a mixing material of any fluorine resin of PTFE, PFA and FEP and polyimide resin or polyamide-imide resin.

5. The separating plate according to claim 1, wherein the gap exists by contacting the abutting parts with both sides of an area of the fixing member where transfer paper passes.

6. The separating plate according to claim 1, wherein the abutting parts have a height higher than that of the edge part by the gap.

7. The separating plate according to claim 1, wherein the abutting parts have bent leading ends which contact in a tangent direction with opposite portions of the fixing member where the transfer paper does not pass.

8. The separating plate according to claim 1, wherein the abutting parts have leading ends which are turned over on a side of the fixing member to contact with opposite portions of the fixing member where the transfer paper does not pass.

9. A fixing device, comprising:

a fixing member;

a pressure member forcibly contacting with the fixing member; and a separating plate for separating a transfer paper ejected from a nipping part formed by the fixing member and the pressure member contacting with the fixing member, from the fixing member, wherein the separating plate includes an edge part disposed close to the fixing member, and abutting parts provided on areas of the edge part where the transfer paper does not pass and configured to be in contact with the fixing member to form a gap between the edge part and the fixing member, the abutting parts being disposed downstream of the edge part in a moving direction of the fixing member, wherein the abutting parts include bent portions having contacting surfaces which contact in a tangent direction with a circumference surface of the fixing member at opposite side portions thereof, wherein the separating plate is disposed relative to the fixing member so that a sum of a thickness of the edge part of the separating plate and the gap between the edge part and the fixing member is less than a minimum lift height of the transfer paper ejected from the nipping part.

10. The fixing device according to claim 9, wherein a mold releasing member is disposed on a portion of the edge part near a surface where the transfer paper passes.

11. The fixing device according to claim 9, wherein the gap exists by contacting the abutting parts with both sides of an area of the fixing member where transfer paper passes.

12. The fixing device according to claim 11, wherein the abutting parts have a height higher than that of the edge part by the gap.

13. The fixing device according to claim 11, wherein the abutting parts have leading ends which are turned over to contact in a tangent direction with opposite portions of the fixing member where the transfer paper does not pass.

14. The fixing device according to claim 11, wherein the abutting parts have leading ends which are turned over on a side of the fixing member to contact with opposite portions of the fixing member where the transfer paper does not pass.

15. An image forming apparatus comprising the separating plate as recited in claim 1.

16. An image forming apparatus comprising the fixing device as recited in claim 9.

* * * * *